US005556306A

United States Patent [19]

Lin et al.

[11] Patent Number: 5,556,306

[45] Date of Patent: Sep. 17, 1996

[54] STAMPED CANTILEVER CONTACT HAVING CLOSED-TYPE ENGAGEMENT PORTION

[75] Inventors: Yu-Hsu Lin, Fremont; Lee-Ming Cheng, Cupertino, both of Calif.

[73] Assignee: Hon Hai Precision Ind. Co., Ltd., Taiwan

[21] Appl. No.: 349,059

[22] Filed: Dec. 2, 1994

[51] Int. Cl.[6] ..... H01R 23/70

[52] U.S. Cl. ..... 439/637; 439/862

[58] Field of Search ..... 439/630–637, 439/733.1, 444, 862, 869, 68, 70

[56] References Cited

U.S. PATENT DOCUMENTS

| | | | |
|---|---|---|---|
| 4,324,451 | 4/1982 | Ammon et al. | 439/637 |
| 4,973,270 | 11/1990 | Billman et al. | 439/630 |
| 4,995,816 | 2/1991 | Grabbe | 439/68 |
| 4,995,817 | 2/1991 | Grabbe | 439/70 |
| 5,082,459 | 1/1992 | Billman et al. | 439/637 |
| 5,263,870 | 11/1993 | Billman et al. | 439/637 |
| 5,366,390 | 11/1994 | Kinross et al. | 439/636 |

*Primary Examiner*—David L. Pirlot
*Assistant Examiner*—Jill Demello

[57] ABSTRACT

A contact (20) for use with a card edge connector (10) includes a horizontal base (22) from which a pair of retention sections (24) extend at two opposite ends, a tail section (28) extends downwardly, and a contact section (30) extends upwardly. The contact section (30) includes a curved beam body (32) and a closed-type engagement portion (34) at the top of the beam body (32) wherein such engagement portion (34) is generally of a triangle configuration comprising a suspension section (42) substantially smoothly extending continuously from the top of the curved beam body (34), an engaging section (44) extending downwardly from the upper end (50) of the suspension section (42) for engagement with the inserted card (15) in the connector (10), and a holding section (46) extending between two lower ends (48, 56) of the suspension section (42) and the engaging section (44).

1 Claim, 4 Drawing Sheets

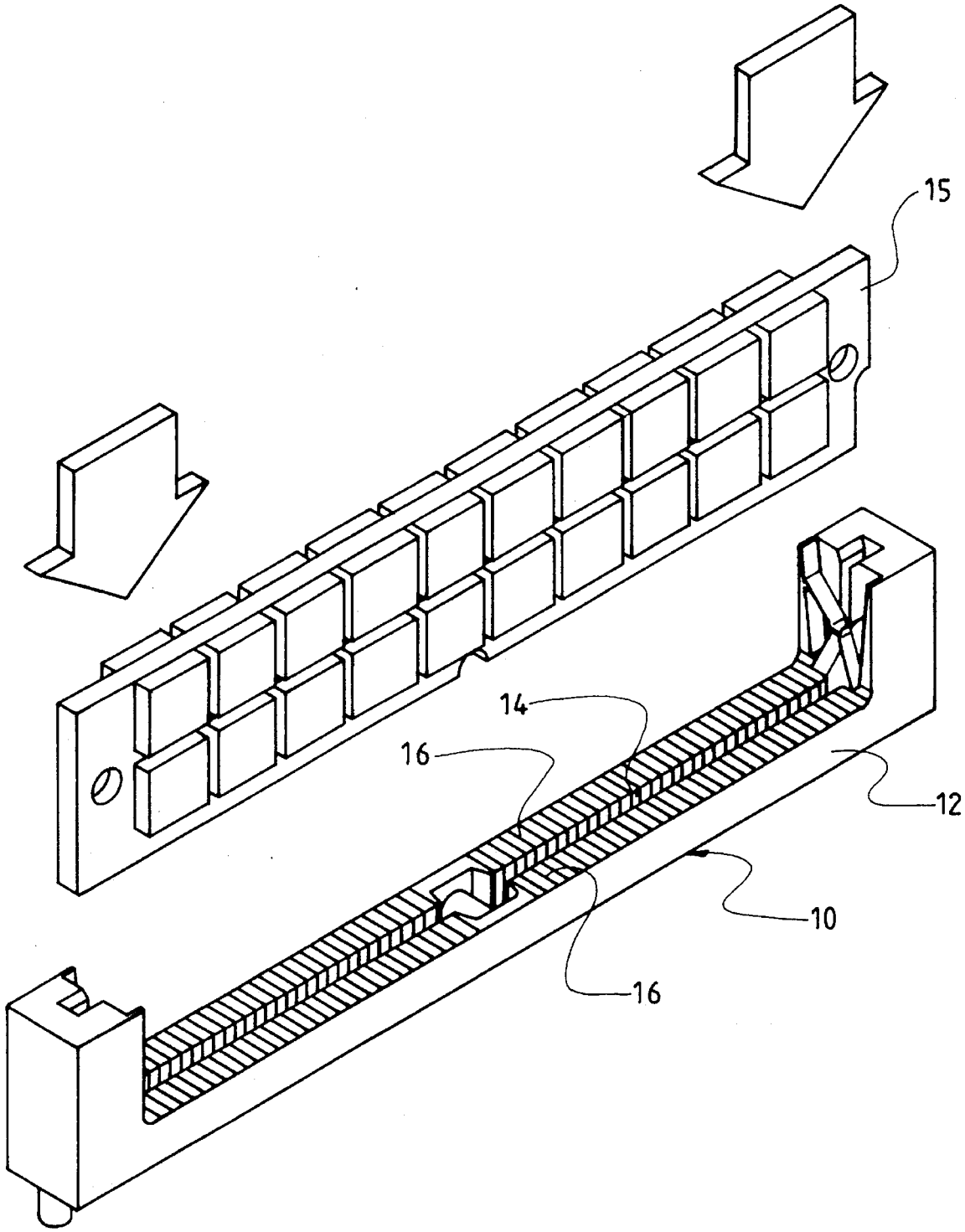
FIG,2

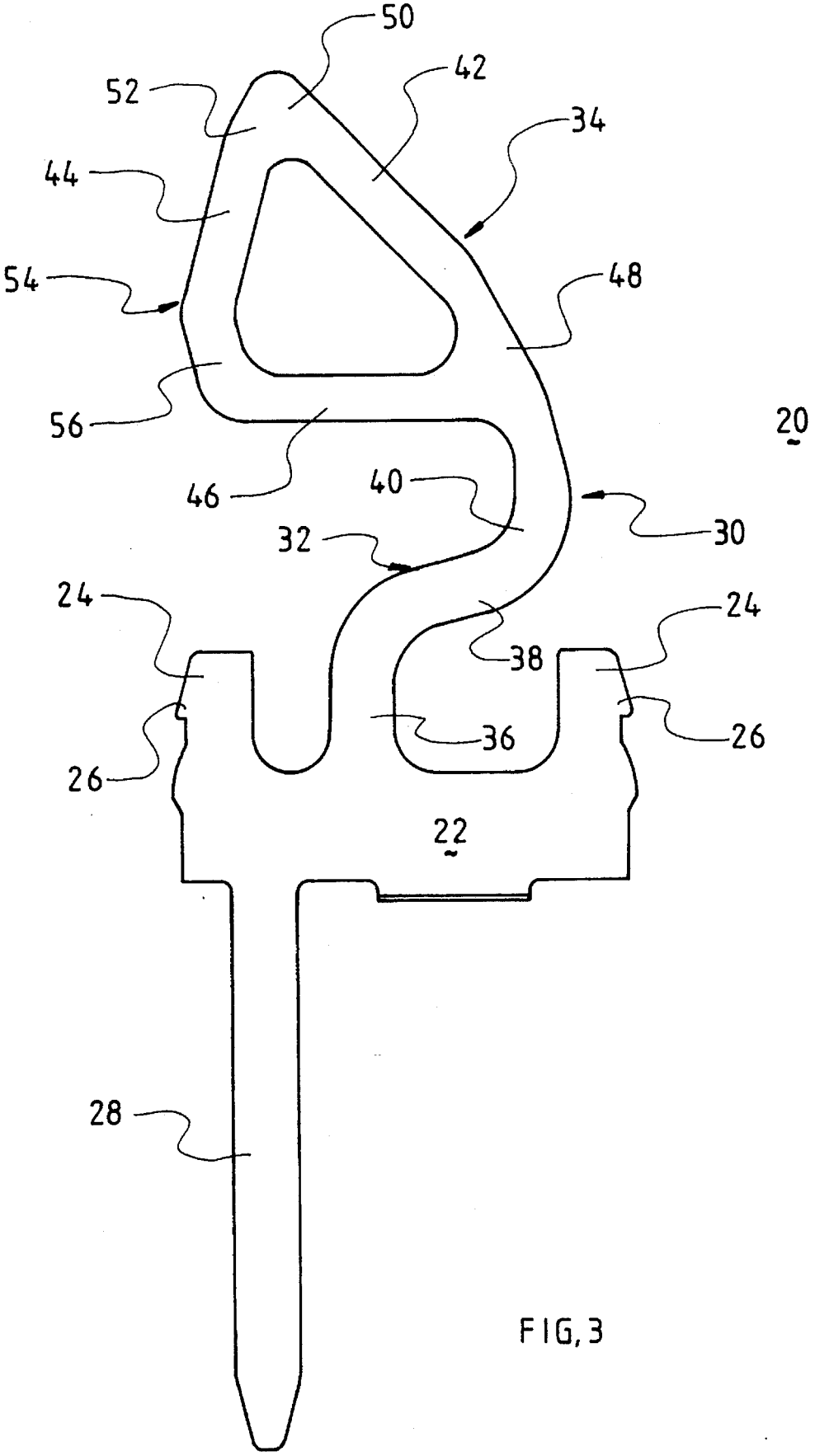
FIG, 3

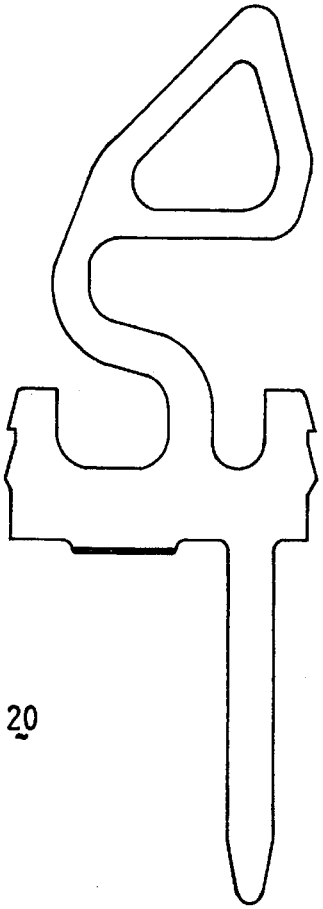
FIG, 5
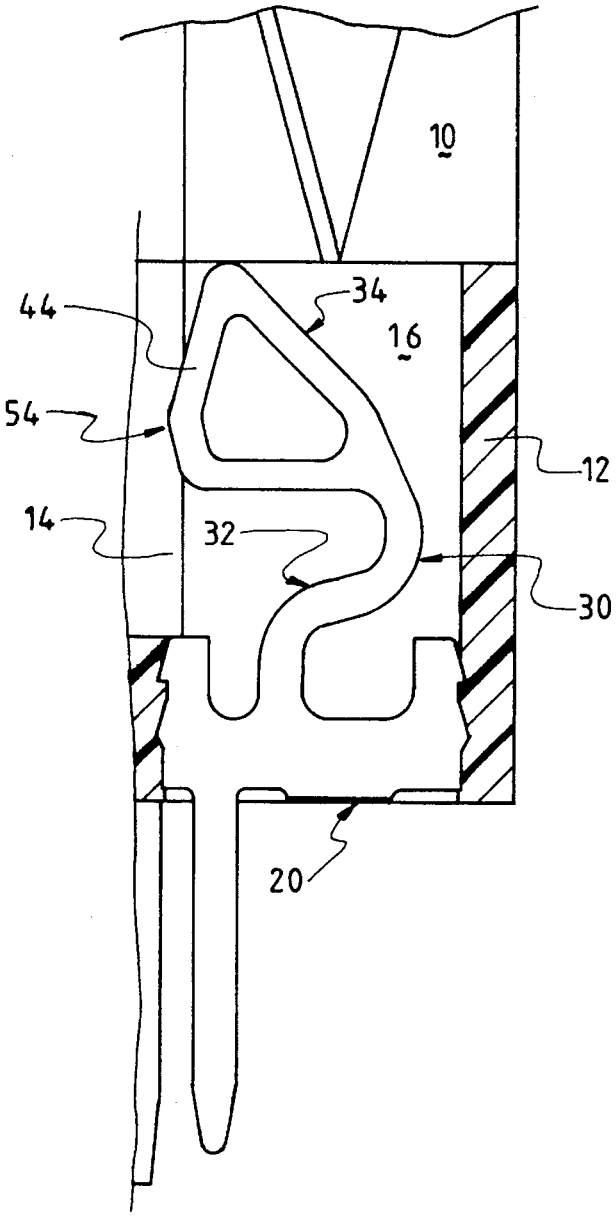
FIG, 4

STAMPED CANTILEVER CONTACT HAVING CLOSED-TYPE ENGAGEMENT PORTION

BACKGROUND OF THE INVENTION

1. Field of the Invention

The invention relates to card edge connectors, especially to contacts for use within such card edge connectors wherein each whole contact is generally of a cantilever type and a closed-type engagement portion is substantially positioned at the top of the beam body of such cantilever contact.

2. The Prior Art

As shown in FIG. 1 which is the primary figure of U.S. Pat. No. 4,996,766 disclosing two types of the formed contacts used within a card edge connector, one (101) is of a cantilever type and the other (102) is of a bellow type. Till now and as well known, most prior art card edge connectors use either of such two types of contacts. As experienced, because of lack of the proper support of the contact structure itself, the cantilever type contact may tend to crash under the situation that an improper misaligned insertion of the card into the connector housing, and the bellow type contact may tend to crash under the other situation that an improper misaligned withdrawal of the card from the connector housing. To prevent the aforementioned two disadvantages, the expensive stiff material is required for contacts to resist the possible larger action force, or the tolerances of the corresponding components become strict. Either of them will significantly increase the manufacturing cost.

Accordingly, an object of the present invention is to provide a contact in the connector which has a better character to resist the possible improper applied force during the insertion or withdrawal period of the card without crash.

SUMMARY OF THE INVENTION

A contact for use with a card edge connector includes a horizontal base from which a pair of retention sections extend at two opposite ends, a tail section extends downwardly, and a contact section extends upwardly. The contact section includes a curved beam body and a closed-type engagement portion at the top of the beam body wherein such engagement portion is generally of a triangle configuration comprising a suspension section substantially smoothly extending continuously from the top of the curved beam body, an engaging section extending downwardly from the upper end of the suspension section for engagement with the inserted card in the connector, and a holding section extending between two lower ends of the suspension section and the engaging section.

BRIEF DESCRIPTION OF THE DRAWINGS

FIG. 2 is a perspective view of a card edge connector of a presently preferred embodiment according to the invention.

FIG. 3 is a plane view of the contact on one side of the connector of FIG. 2.

FIG. 4 is a cross-sectional view of the connector of FIG. 2 with the contact of FIG. 3 therein.

FIG. 5 is a plane view of the contact on the other side of the connector of FIG. 2.

DETAILED DESCRIPTION OF THE PREFERRED EMBODIMENT

Figure 1:
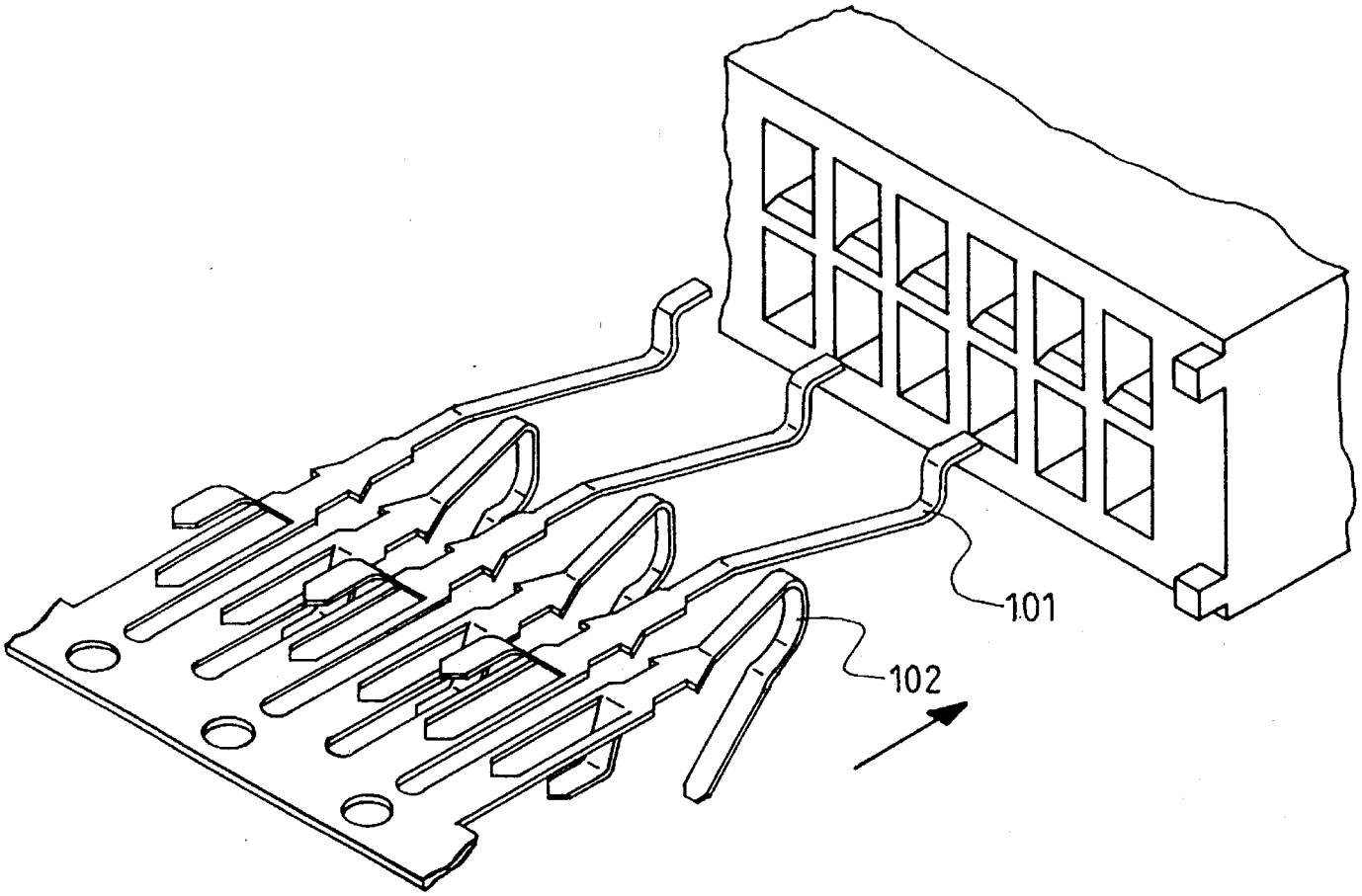
FIG. 1 PRIOR ART
FIG. 1 is a fragmental perspective view of a card edge connector and the corresponding contacts of the prior art card edge connector.

References will now be made in detail to the preferred embodiments of the invention. While the present invention has been described with reference to the specific embodiment, the description is illustrative of the invention and is not to be construed as limiting the invention. Various modifications to the present invention can be made to the preferred embodiment by those skilled in the art without departing from the true spirit and scope of the invention as defined by appended claims.

It will be noted here that for a better understanding, most of like components are designated by like reference numerals throughout the various figures in the embodiments. Attention is now directed to FIG. 2 wherein a card edge connector 10 includes an elongated insulative housing 12 having a central slot 14 for receiving the lower edge portion of a card 15. By two sides of the slot 14, a plurality of cavities 16 vertically extending through the housing 12 for receiving therein a corresponding number of contacts 20 (FIG. 3) wherein each cavity 16 communicates with the slot 14.

As shown in FIGS. 3 and 4, each contact 20 in the right side row of cavities 16 includes a horizontal base 22 from which a pair of retention sections 24 extend upwardly at two opposite ends wherein retention sections have barbs 26 extending laterally on two sides for interferential engagement within the corresponding cavity 16. A tail section 28 extends downwardly from the base 22 for mounting in a board (not shown) on which the connector 10 is seated, and a contact section 30 extends upwardly from the base 22.

Each contact section 30 includes a curved beam body 32 in the lower half portion and an engagement portion 34 in the upper half portion. Such beam body 32 includes a first section 36 vertically extending from the left side of the base 32, a second section 38 successively generally extending horizontally from the top of the first section 36 and to the right side of the contact 20, and a third section 40 successively generally extending slightly curvilinearly from the top of the second section 38 toward the left side of the contact 20. It can be seen that the upper end of the third section 40 of the beam body 32 terminates on the right side of the contact 20, i.e., not beyond the center line of the contact 20.

The engagement portion 34 is substantially of a generally closed-type triangle configuration composed of a suspension section 42, an engaging section 44 and a holding section 46 wherein the suspension section 42 integrally extending, with its lower ends 48, smoothly continuously from the top of the third section 40 to the left side of the contact 20 so that the distal upper end 50 of the suspension section 42 is close to the central slot 14 of the connector 10. The engaging section 44 extends downwardly, with its upper end 52, from the upper end 50 of the suspension section 42 and slightly obliquely into the slot 14 so that the apex 54 of the engaging section 44 substantially protrudes into the slot 14 for engagement with the corresponding pads on the lower edge portion of the inserted card 15. The holding section 46 is generally horizontally integrally connected between the lower end 48 of the suspension section 42 and the lower end 56 of the engaging section 44.

Therefore, the engagement portion 34 is substantially of a rigid style, which includes not only the additional suspension section 42 in comparison with the conventional cantilever type contact for reinforcement of the structure thereof to resist the improper misaligned insertion of the card 15, but also the additional fixed holding section 46 in comparison with the conventional bellow type contact for reinforcement of the structure thereof to resist the improper misaligned withdrawal of the card 15. Accordingly, the contact 20 in the present invention has a better character for not failing during electrical and mechanical engagement with the inserted card which may have a larger range of its thickness variety or an unbalanced insertion or withdrawal with regard to the connector 10.

As shown in FIG. 5, the contact section 30 of the left side contact 20 may be of a mirror image with regard to that of the right side contact as shown in FIGS. 3 and 4, so that the card 15 inserted within the slot 14, may have a balanced normal force applied thereto for even engagement with the connector 10.

It can been noted that in an overall analysis, the whole contact section 30 may be deemed as a cantilever type due to the curved beam body 32 thereof when it resist the reaction force of the inserted card 15. But in a detailed analysis, the engagement portion 34, which substantially and specifically engages the inserted card 15, is not of a conventional cantilever type or a bellow type, but of the combination type of the cantilever and the bellow types which provides a better reinforcement structure for the whole contact section 30 to fight against the insertion and withdrawal of the card 15. Understandably, To the whole structure of the contact section 30, the beam body 32 is substantially much flexible than the rigid engagement portion 34, so that the deformation of the rigid engagement portion 34 is substantially much smaller than the displacement of the beam body 32.

While the present invention has been described with reference to a specific embodiment, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A contact for use with a card edge connector, comprising:

a horizontal base;

at least one retention section extending from said horizontal base;

a contact section extending upwardly from said base, said contact section further including a curved beam body in a lower portion and an engagement portion in an upper portion, wherein said engagement portion is of substantially and completely a rigid closed-type configuration whereby a deformation of said engagement portion is much smaller than a displacement of said beam body;

said engagement portion comprising a suspension section, an engaging section and a holding section; wherein the suspension section generally upwardly extends from a top portion of the curved beam body, the engaging section generally downwardly extends from a top portion of the suspension section, and the holding section is integrally connected between a lower end of the suspension section and a lower end of the engaging section whereby the top portion of the curved beam is connected to the suspension section and the holding section and is substantially spaced far away from and opposite to the engaging section.

* * * * *